US008678564B2

(12) United States Patent
Wijshoff et al.

(10) Patent No.: US 8,678,564 B2
(45) Date of Patent: Mar. 25, 2014

(54) INKJET PRINT HEAD

(71) Applicant: Oce-Technologies B.V., Venlo (NL)

(72) Inventors: Hermanus M. A. Wijshoff, Grevenbricht (NL); Peter Klein Meuleman, Venlo (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 13/829,090

(22) Filed: Mar. 14, 2013

(65) Prior Publication Data

US 2013/0194351 A1 Aug. 1, 2013

Related U.S. Application Data

(63) Continuation of application No. PCT/EP2011/066187, filed on Sep. 19, 2011.

(30) Foreign Application Priority Data

Oct. 1, 2010 (EP) ..... 10185813

(51) Int. Cl.
*B41J 2/045* (2006.01)

(52) U.S. Cl.
USPC ..... 347/68; 347/70; 347/71; 347/72; 347/65

(58) Field of Classification Search
USPC ..... 347/68–72, 65
See application file for complete search history.

(56) References Cited

U.S. PATENT DOCUMENTS

| | | | | |
|---|---|---|---|---|
| 2009/0244131 | A1 | 10/2009 | Shibata | |
| 2010/0208004 | A1 | 8/2010 | Ottosson et al. | |
| 2010/0214334 | A1 | 8/2010 | Kusunoki et al. | |
| 2010/0225706 | A1 | 9/2010 | Yamamoto | |
| 2011/0148988 | A1* | 6/2011 | Hoisington et al. | 347/54 |

FOREIGN PATENT DOCUMENTS

WO WO 2009/143362 A1 11/2009

* cited by examiner

*Primary Examiner* — Henok Legesse
(74) *Attorney, Agent, or Firm* — Birch, Stewart, Kolasch & Birch, LLP

(57) ABSTRACT

In an inkjet print head an actuation chamber substantially extends in a first direction and the actuation chamber is associated with a piezo actuator arranged to generate a pressure wave in the actuation chamber. The pressure wave propagates in said first direction. A nozzle is associated with the actuation chamber such that a droplet may be expelled through the nozzle upon generation of the pressure wave in the actuation chamber. A reservoir is in fluid communication with the actuation chamber via an inlet and an outlet of the actuation chamber. A pump means is provided for pumping ink from the reservoir, via the inlet, through the actuation chamber, via the outlet back into said reservoir. The print head is provided with a means for reflecting the pressure wave at the outlet of the actuation chamber for enabling to generate a sufficient pressure at the nozzle for expelling the droplet.

14 Claims, 3 Drawing Sheets

INKJET PRINT HEAD

CROSS REFERENCE TO RELATED APPLICATIONS

This application is a continuation of PCT/EP2011/066187 filed on Sep. 19, 2011, which claims priority under 35 U.S.C. 119(a) to European Patent Application No. 10185813.2 filed on Oct. 1, 2010, all of which are hereby expressly incorporated by reference into the present application.

FIELD OF THE INVENTION

The present invention generally pertains to inkjet printing and in particular to a print head assembly.

BACKGROUND ART

In a known inkjet print head, ink is arranged in a pressure chamber. The pressure chamber has an ink inlet at a first side of the pressure chamber and a nozzle at a second side, opposite of the first side. The pressure chamber ends at the nozzle. No ink may flow beyond the nozzle other than by being jetted through the nozzle. So, for example if no ink is jetted, dirt and/or air bubbles may become trapped in the pressure chamber, near the nozzle. With a large amount of dirt or with large air bubbles, or other similar irregularities in the pressure chamber, a droplet ejection may become disturbed or the nozzle may become blocked completely.

In another known inkjet print head, another arrangement of the print head is selected. A continuous flow of ink passes through an ink channel. At a first side of the ink channel, an actuator, for example a piëzo actuator or a heating element for thermal actuation as well known in the art, is arranged opposite a nozzle arranged at a second, opposite side of the ink channel. Due to the continuous flow, there is less chance that an air bubble or dirt becomes trapped near the nozzle as it may flow with the ink through the ink channel towards a central reservoir. In the ink channel, for example in the ink reservoir a filter means may be provided for removing dirt and/or air from the ink coming from the ink channel returning to the reservoir. Thus, air bubble free and dirt free ink may be re-introduced in the ink channel.

A disadvantage of the latter, known print head is the fact that it is not suited to be used in combination with certain inks, for example high viscosity inks, since an actuation efficiency, that is an actuation pressure generated by the actuator, is significantly decreased. More in particular, in the known continuous flow print head, the actuation efficiency is about 50% lower compared to the above first mentioned print head (having the nozzle arranged at an end of the pressure chamber).

SUMMARY OF THE INVENTION

In an aspect of the present invention, a print head is provided comprising at least one actuation chamber, wherein a main part of the actuation chamber substantially extends in a first direction. Each actuation chamber is associated with a respective piezo actuator, a chamber inlet, a nozzle and a chamber outlet.

The piezo actuator is arranged to generate a pressure wave in the main part of the actuation chamber, the pressure wave propagating in the first direction.

The chamber inlet is arranged at a first end of the actuation chamber.

The nozzle is arranged in fluid communication with the associated actuation chamber such that a droplet may be expelled through the nozzle upon generation of the pressure wave in the associated actuation chamber.

The chamber outlet is arranged at a second end of the associated actuation chamber.

The print head further comprises a reservoir in fluid communication with the chamber inlet and the chamber outlet of the at least one actuation chamber and further comprises a pump means for pumping ink from the reservoir, through the chamber inlet, through the actuation chamber, through the chamber outlet and into said reservoir.

The inkjet print head according to the present invention comprises a means for reflecting the pressure wave which means is provided at the second end of the actuation chamber.

Suitably reflecting the pressure wave is advantageous for generating a sufficient pressure at the nozzle for expelling the droplet, as is explained hereinbelow in more detail. As a result, in comparison with the print head having the nozzle arranged at an end of the pressure chamber, an efficiency decrease of only 10% or less is obtainable.

In an embodiment, multiple, i.e. at least two, actuation chambers and associated parts are coupled to a single reservoir.

In an embodiment, the means for reflecting the pressure wave comprises a compliance provided at the second end of the actuation chamber. The compliance, e.g. provided by an elastic member, ensures that a reflection of the pressure wave occurs, as is known in the art. A suitably selected compliance will provide a suitable reflection. In a particular embodiment, a nozzle plate provides the nozzles of the print head and the nozzle plate is selected to be flexible and elastic. When arranged suitably, the nozzle plate provides the compliance.

In an embodiment, a cross-section of the actuation chamber just upstream of the chamber outlet is substantially smaller than the cross-section of an ink channel just downstream of the chamber outlet. Such a change in cross-section acts on a pressure wave as a kind of open end of the actuation chamber. As a result, a pressure wave will mainly reflect (a small part of the pressure wave may propagate through the chamber outlet into the ink channel). A suitable selection of cross-sections allows to control the ratio of the reflected part and the propagating part of the pressure wave.

In an embodiment, a first pressure wave is generated by the piezo actuator, the first pressure wave propagating towards the second end of the actuation chamber and, after reflection at the second end, propagating towards the nozzle. Further, a subsequent second pressure wave is generated by the piezo actuator, wherein the second pressure wave also propagates towards the second end. The dimensions of the actuator chamber and the timing of the second pressure wave relative to the first pressure wave are selected such that (i) the reflection of the first pressure wave and (ii) the second pressure wave arrive at the nozzle at the same time such that a large pressure is provided by the sum of the reflection of the first pressure wave and the second pressure wave. Thus, a suitably high pressure is generated at the nozzle, resulting in expelling a droplet through the nozzle.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinafter and the accompanying schematical drawings which are given by way of illustration only, and thus are not limitative of the present invention, and wherein.

DETAILED DESCRIPTION OF THE DRAWINGS

Figure 1A:
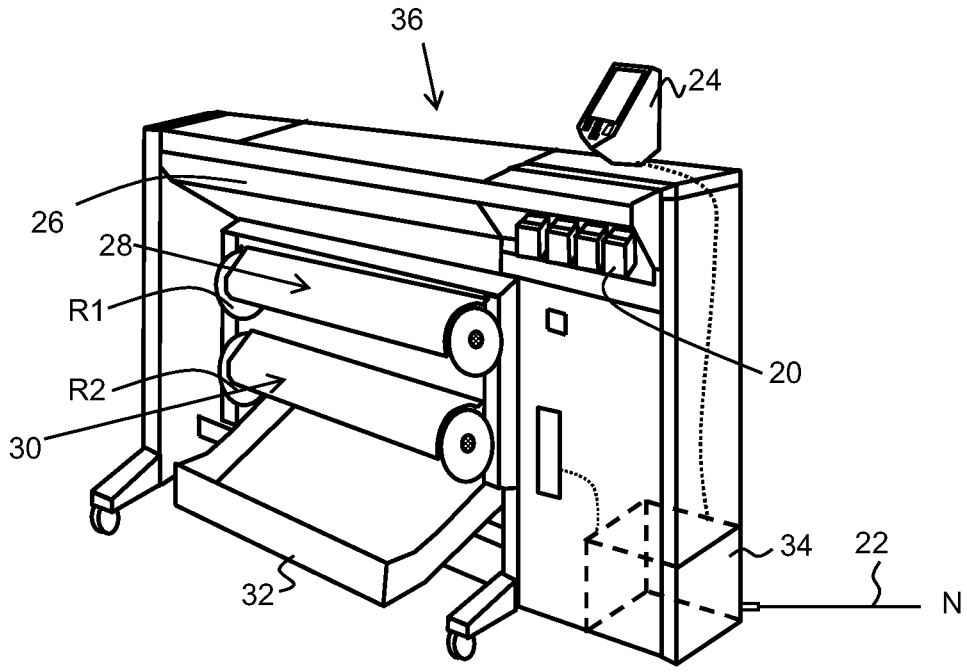
FIG. 1A shows a perspective view of an image forming apparatus.

The present invention will now be described with reference to the accompanying drawings, wherein the same reference numerals have been used to identify the same or similar elements throughout the several views.

Figure 1B:
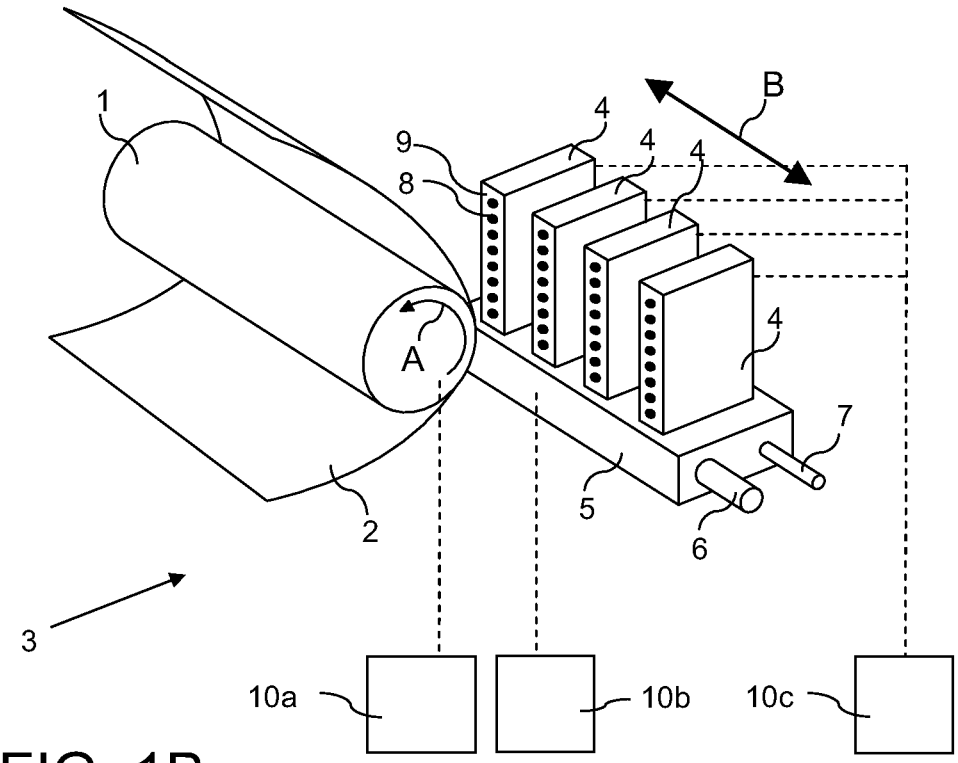
FIG. 1B schematically illustrates an inkjet printing assembly.

FIG. 1A shows an image forming apparatus 36, wherein printing is achieved using a wide format inkjet printer. The wide-format image forming apparatus 36 comprises a housing 26, wherein the printing assembly, for example the ink jet printing assembly shown in FIG. 1B is placed. The image forming apparatus 36 also comprises a storage means for storing image receiving member 28, 30, a delivery station to collect the image receiving member 28, 30 after printing and storage means for marking material 20. In FIG. 1A, the delivery station is embodied as a delivery tray 32. Optionally, the delivery station may comprise processing means for processing the image receiving member 28, 30 after printing, e.g. a folder or a puncher. The wide-format image forming apparatus 36 furthermore comprises means for receiving print jobs and optionally means for manipulating print jobs. These means may include a user interface unit 24 and/or a control unit 34, for example a computer.

Images are printed on a image receiving member, for example paper, supplied by a roll 28, 30. The roll 28 is supported on the roll support R1, while the roll 30 is supported on the roll support R2. Alternatively, cut sheet image receiving members may be used instead of rolls 28, 30 of image receiving member. Printed sheets of the image receiving member, cut off from the roll 28, 30, are deposited in the delivery tray 32.

Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The image forming apparatus 36 may optionally be connected to a network N. The connection to the network N is diagrammatically shown in the form of a cable 22, but nevertheless, the connection could be wireless. The image forming apparatus 36 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting an image receiving member 2. The supporting means are shown in FIG. 1B as a platen 1, but alternatively, the supporting means may be a flat surface. The platen 1, as depicted in FIG. 1B, is a rotatable drum, which is rotatable about its axis as indicated by arrow A. The supporting means may be optionally provided with suction holes for holding the image receiving member in a fixed position with respect to the supporting means. The ink jet printing assembly 3 comprises print heads 4*a*-4*d*, mounted on a scanning print carriage 5. The scanning print carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material.

A scanning print carriage 5 carries the four print heads 4*a*-4*d* and may be moved in reciprocation in the main scanning direction B parallel to the platen 1, such as to enable scanning of the image receiving member 2 in the main scanning direction B. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guiding means 6, 7. These guiding means 6, 7 may be rods as depicted in FIG. 1B. The rods may be driven by suitable driving means (not shown). Alternatively, the carriage 5 may be guided by other guiding means, such as an arm being able to move the carriage 5. Another alternative is to move the image receiving material 2 in the main scanning direction B.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9, may negatively influence the ejection of droplets and the placement of these droplets on the image receiving member 2. Therefore, it may be advantageous to remove excess of ink from the orifice surface 9. The excess of ink may be removed for example by wiping with a wiper and/or by application of a suitable anti-wetting property of the surface, e.g. provided by a coating.

Figure 2A:
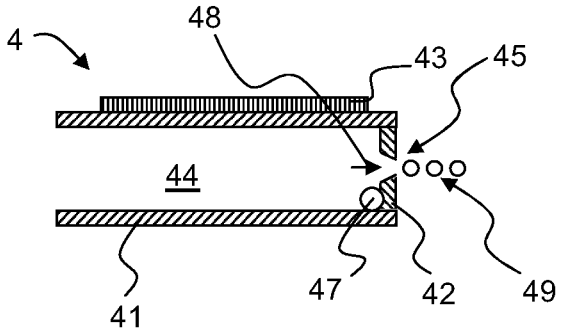
FIG. 2A PRIOR ART
FIG. 2A schematically illustrates a first simplified prior art inkjet print head.

FIG. 2A shows an actuation chamber 44 as a part of a prior art inkjet print head 4. The actuation chamber 44 is formed by a main body 41 and a nozzle plate 42, having arranged therein a nozzle 45. A piezo actuator element 43 is arranged on a side wall of the actuation chamber 44 such that upon actuation the wall deforms and a pressure wave is generated in the actuation chamber 44. The pressure wave is generated such that an actuation pressure is provided near the nozzle 45 in an actuation direction 48, parallel to a direction in which the actuator 43 extends, resulting in expelling droplets 49. In practice, a dirt particle or an air bubble 47 may become trapped in the nozzle 45 or the actuation chamber 44. An air bubble 47 in the actuation chamber 44 damps any pressure wave generated in the actuation chamber 44 resulting in a decreased pressure near the nozzle 45 and hence in deteriorated droplet formation. A dirt particle in or near the nozzle 45 evidently also result in deteriorated droplet formation. A dirt particle or air bubble 47 however cannot escape and may therefore in a worst case result in a permanently unusable actuation chamber 44 and nozzle 45.

Figure 2B:
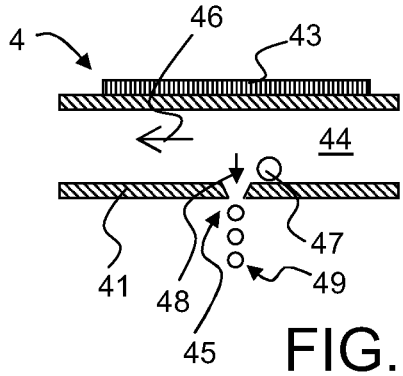
FIG. 2B PRIOR ART
FIG. 2B schematically illustrates a second simplified prior art inkjet print head.

In FIG. 2B, another known inkjet print head 4 is shown in a simplified drawing. An actuation chamber 44 is formed in a main body 41, wherein a nozzle 45 is arranged. Opposite to the nozzle 45, an actuator 43 is arranged. In the inkjet print head 4 of FIG. 2B, the actuator 43 is may be a thermistor for thermal actuation: a sudden local heating of the ink by the actuator 43 results in a bubble of vapor. Vapor requires more volume than the original liquid ink and consequently the pressure in the ink increases in an actuation direction 48 perpendicular to a direction in which the actuator 43 extends and as a result a droplet 49 may be expelled through the oppositely arranged nozzle 45. However, in an embodiment as known from the prior art, the actuator 43 may be a piëzo actuator (i.e. an electromechanical transducer), which increases and/or reduces a volume of the pressure chamber 44 when supplied with a driving voltage. The volume change results in a pressure wave that may result in a droplet being expelled through the nozzle 45.

In the print head 4 as shown in FIG. 2B, a dirt particle or an air bubble 47 may become trapped. However, the ink continuously flows in a flow direction 46. The air bubble 47 may be carried by the ink away from the nozzle 45 and consequently there is a smaller chance that the nozzle 45 may be unusable due to a blockage of the nozzle 45.

While it is apparent that the method employed in the print head shown in FIG. 2B may be desirable for a stable jetting process, a print head having a thermal actuation is only suitable for use with solvent based inks, such as aqueous inks, of which the solvent may quickly vaporize. Further, independent of the kind of actuator, a low viscosity of the ink is required, since only a relatively small pressure can be generated near the nozzle 45 in the actuation direction 48. A significant part of the generated pressure is lost in the direction perpendicular to the actuation direction 48, i.e. parallel to the flow direction 46. For non-solvent based inks, such as hot-melt inks for example, and/or highly viscous inks, an inkjet print head 4 as shown in FIG. 2A is known and available, but a print head providing a continuous flow of ink through the actuation chamber 44 and along the nozzle 45 is not available due to such pressure loss.

Figure 3A:
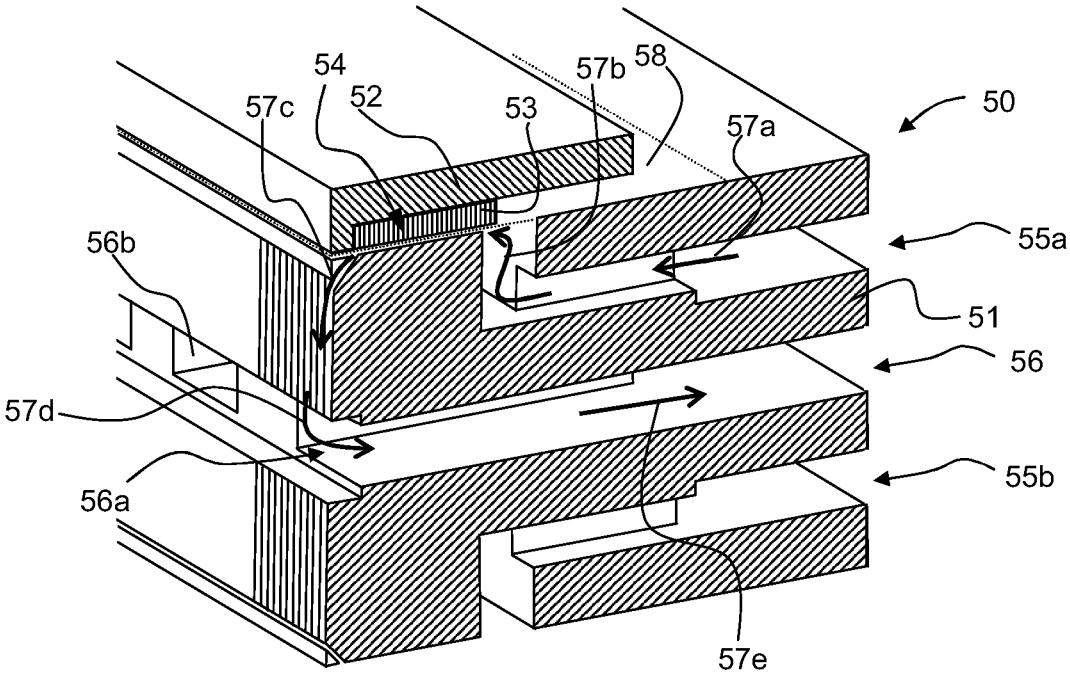
FIG. 3A schematically shows a perspective view of a cross-section of a first embodiment of an inkjet print head in accordance with the present invention.
Figure 3B:
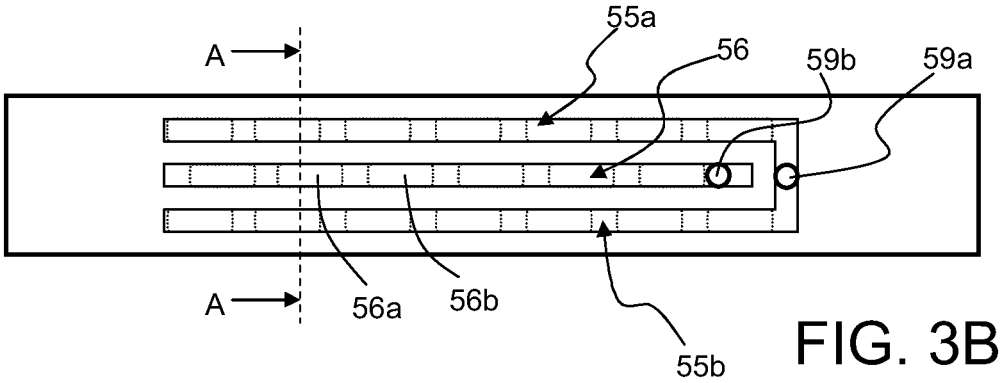
FIG. 3B schematically shows a side view of the print head shown in FIG. 3A.
Figure 3C:
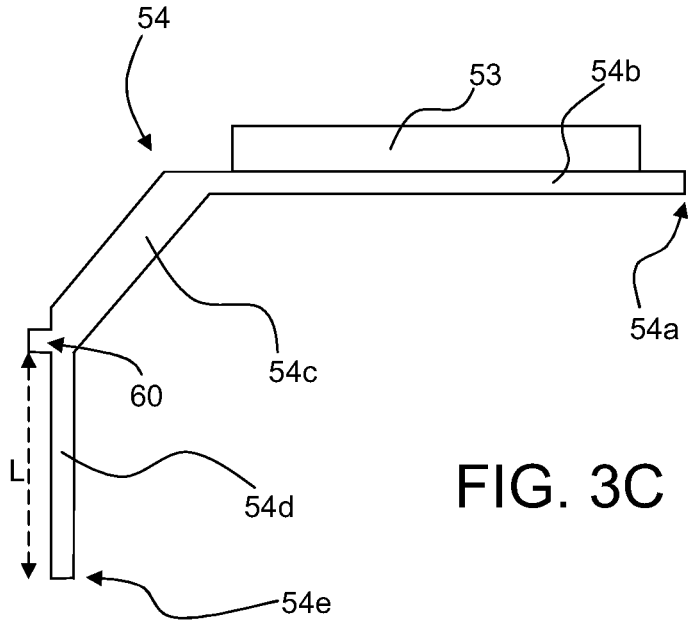
FIG. 3C schematically illustrates an actuation chamber of the print head shown in FIG. 3A.

FIG. 3A-3C illustrate an embodiment of a print head 50 in accordance with the present invention providing an actuation method in accordance with the print head 4 shown in FIG. 2A and providing a continuous flow of ink through the actuation chamber 54 (FIG. 3A), 54*a*-54*e* (FIG. 3C). The inkjet print head 50 has a main body 51 of any suitable material. For example, graphite or silicon may be used but also other materials suited for fine mechanical processing may be employed. A number of piezo actuators 53 are arranged on an actuator support element 52. Each actuator 53 is associated with one of a number of actuator chambers 54 such that upon actuation a droplet may be expelled through an associated nozzle 60. A suitable flexible sheet material 58 is arranged between the respective actuators 53 and the actuator chambers 54.

The print head 50 is provided with a first ink inlet 55*a*, a second ink inlet 55*b* and an ink outlet 56. An ink flow path is arranged in the print head 50 starting at the first ink inlet 55*a*, flowing through a passage as indicated by an arrow 57*a* towards an actuator chamber 54 as indicated by an arrow 57*b*, through the actuator chamber 54 as indicated by an arrow 57*c* and subsequently through a first outlet passage 56*a* as indicated by an arrow 57*d* towards the ink outlet 56 as indicated by an arrow 57*e*.

A similar second ink flow path starts at the second ink inlet 55*b*. Please note that a second actuator support element and a second number of piezo actuators is not shown, but may in practice be present. On the other hand, in an embodiment, only a single flow path may be provided by omitting the second flow path.

Now referring in particular to FIG. 3B, a back side of the print head 50 is shown. The back side is opposite to a front side, wherein the front side comprises the nozzles 60. The back side comprises the first and the second ink inlets 55*a*, 55*b* and the ink outlet 56. As illustrated in FIG. 3B, the first ink inlet 55*a* and the second ink inlet 55*b* are each in fluid connection with a main ink inlet terminal 59*a* and the ink outlet 56 is in fluid communication with a main ink outlet 59*b*.

Closing the back side of the print head 50 by arranging a suitable cover over the back side, wherein the main ink inlet 59*a* and the main ink outlet 59*b* project through the cover enables to supply ink to and receive ink from the inkjet print head 50. In a printing assembly, e.g. as shown in FIG. 1B, an ink reservoir and a pump means may be provided such that ink may be pumped from such an ink reservoir to the main ink inlet 59*a*, through the inkjet print head 50 and through the main ink outlet 59*b* back to the reservoir in a continuous flow.

Now turning to FIG. 3C, the operation of the print head 50 is described in more detail. The actuation chamber 54 is shown in detail. The actuation chamber 54 comprises a chamber inlet 54*a*, a main part 54*b*, a coupling part 54*c*, a drain part 54*d* having a length L and a chamber outlet 54*e*. Ink may enter the actuation chamber 54 at the chamber inlet 54*a*. The chamber inlet 54*a* may have the same characteristics as a chamber inlet of the known print head 4 shown in FIG. 2A. The chamber inlet 54*a* may be configured to substantially reflect a pressure wave propagating in a direction parallel to a direction in which the actuator 53 extends. The piezo actuator 53 may be driven to generate a pressure wave in the main part 54*b* of the actuation chamber 54. The pressure wave may propagate through the main part 54*b* and through the coupling part 54*c* towards the nozzle 60 and even further through the drain part 54*d*. At the chamber outlet 54*e*, the pressure wave is substantially reflected back towards the nozzle 60.

In an exemplary method of operation, the actuator 53 is first driven to increase a volume of the main part 54*b*, thereby generating a first propagating pressure wave. After a predetermined period of time, the actuator 53 is driven to its original position, thereby decreasing the volume of the main part 54*b* and generating a second pressure wave. Based on a predetermined length of the main part 54*b*, the coupling part 54*c* and the length L of the drain part 54*d* and having predetermined a suitable period of time between the generation of the first pressure wave and the second pressure wave, the first pressure wave having been reflected at the chamber outlet 54*e* returns near the nozzle 60 at the same time that the second pressure wave arrives near the nozzle 60, thereby generating sufficient pressure near the nozzle 60 for expelling a droplet through the nozzle 60 with a sufficient size and speed.

Figure 4:
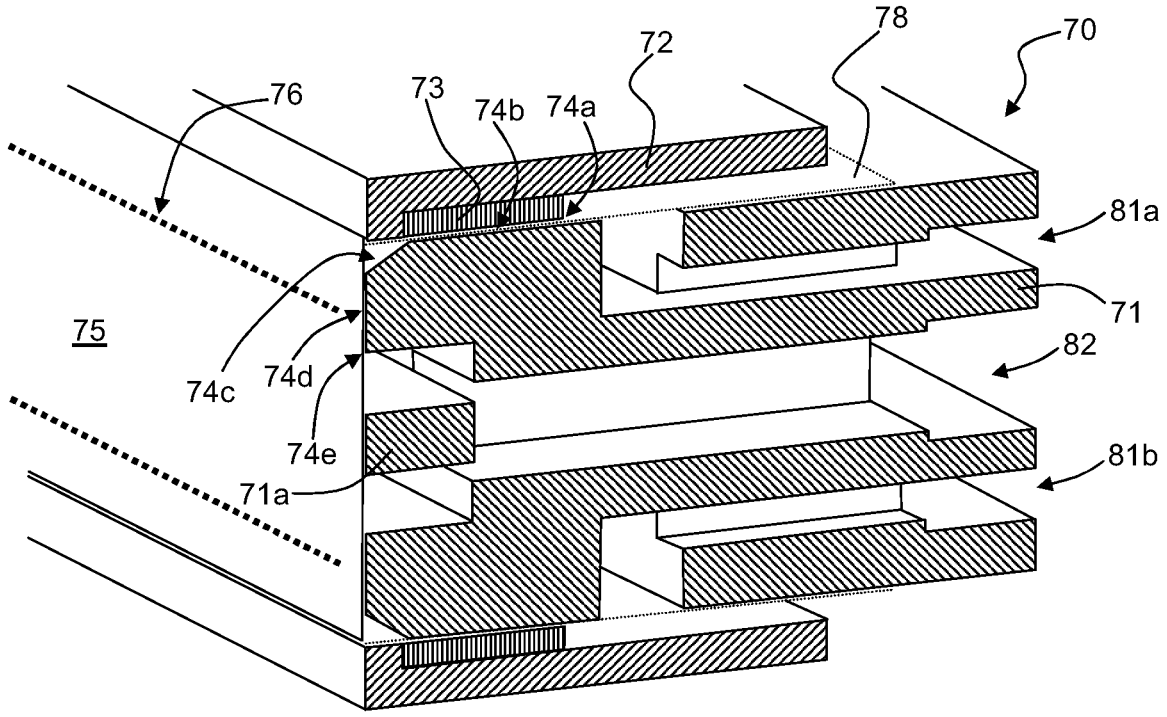
FIG. 4 schematically shows a perspective view of a cross-section of a second embodiment of an inkjet print head in accordance with the present invention.

In order for the pressure wave to suitably reflect at the chamber inlet 54*a*, the flexible sheet material 58 (FIG. 3A) provides a suitable compliance, as known from and used in a known inkjet print head. At the chamber outlet 54*e*, in an embodiment, a similar compliance may be provided. In a particular embodiment, such a compliance is provided by a flexible sheet material arranged over the drain part 54*d* of the actuation chamber 54 and having arranged therein the nozzle 60 (such a sheet material is shown in FIG. 4 and is described and elucidated in the description relating to FIG. 4). Moreover, it is noted that providing a compliance at or near the nozzle, in particular by application of a flexible sheet material having the nozzles arranged therein, may also be advantageously employed in another print head design in order to enable sufficient pressure generation near the nozzle for jetting a high viscosity fluid. In another embodiment, instead of providing a compliance for providing a suitable reflection, a large impedance may be provided as well known in the art.

In another embodiment, suitable reflection of the pressure wave at the chamber outlet 54*e* may be provided due to a cross-section of the ink outlet passages, e.g. the first ink outlet passage 56*a* and a second ink outlet passage 56*b*, that is significantly larger than a cross-section of the drain part 54*d* of the actuation chamber 54.

FIG. 4 shows another embodiment of a print head 70 according to the present invention. The print head 70 comprises a main body 71, an actuator support element 72, an actuator 73, an actuation chamber comprising a chamber inlet 74*a*, a main part 74*b*, a coupling part 74*c*, a drain part 74*d* and a chamber outlet 74*e*. The print head 70 further comprises a nozzle plate 75 having nozzles 76 arranged therein, each nozzle being associated with an actuation chamber, and a flexible sheet member 78 covering the main part 74*b* of the actuation chamber. Ink may be supplied through a first and a second ink inlet 81*a*, 81*b* and ink may leave the print head 70 through an ink outlet 82. Compared to the embodiment shown in FIG. 3A, the print head 70 is additionally provided with a nozzle plate support element 71*a*.

The nozzle plate 75 is, as above mentioned, made of a flexible sheet material in which the nozzles 76 are provided. The flexible nozzle plate 75 covers the drain part 74*d* of the actuation chamber, thereby providing a suitable compliance as described in relation to FIG. 3C. A support surface area of the nozzle plate support element 71*a* may be determined such that the compliance provided by the flexible nozzle plate 75 is suitable. For example, if the support surface area is small, a length of an unsupported part of the flexible sheet is large and the compliance is large. Increasing the support surface area results in a decrease of the unsupported part of the flexible sheet and hence in a decrease of the compliance. Further, the nozzle plate support element 71*a* may assist in reducing cross talk as a result of a part of a pressure wave passing beyond the chamber outlet 74*e*.

Referring to the embodiment as illustrated in FIG. 3A-3C, in FIG. 3A no nozzle plate is shown. However, in practice a nozzle plate is present. Such a nozzle plate may be made of a flexible sheet material as present in the embodiment shown in FIG. 4. In another embodiment, the nozzle plate may be made of a rigid material or any other suitable material.

In an embodiment the nozzle plate formed as a flexible sheet is made of a polyimide sheet material such as Upilex®.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. Inkjet print head comprising at least one elongated actuation chamber, wherein at least a main part of the actuation chamber substantially extends in a first direction, each actuation chamber associated with a respective piezo actuator arranged to generate a pressure wave in the main part of the actuation chamber, the pressure wave propagating in said first direction;

chamber inlet arranged at a first end of the elongated actuation chamber;

nozzle arranged in fluid communication with the associated actuation chamber such that a droplet may be expelled through the nozzle upon generation of the pressure wave in the actuation chamber;

chamber outlet arranged at a second end of the associated actuation chamber;

a reservoir in fluid communication with the chamber inlet and the chamber outlet of the at least one actuation chamber; and a pump means for pumping ink from the reservoir, through the chamber inlet, through the actuation chamber, through the chamber outlet and into said reservoir, wherein a means for reflecting the pressure wave is provided at the second end of the actuation chamber, wherein such means is arranged and configured to generate a sufficient pressure at the nozzle for expelling the droplet, and wherein the means for reflecting the pressure wave comprises a compliance provided at the second end of the actuation chamber.

2. Inkjet print head according to claim 1, the inkjet print head comprising a first actuation chamber associated with a first piezo actuator, with a first chamber inlet, with a first nozzle and with a first chamber outlet; and a second actuation chamber associated with a second piezo actuator, with a second chamber inlet, with a second nozzle and with a second chamber outlet;

wherein the reservoir is in fluid communication with the first actuator chamber and the second actuator chamber.

3. Inkjet print head according to claim 1, wherein the nozzle is arranged in a nozzle plate, the nozzle plate having a suitable flexibility for providing the compliance at the second end of the actuation chamber.

4. Inkjet print head according to claim 1, wherein a cross-section of the actuation chamber at the chamber outlet at the second end of the actuation chamber is substantially smaller than a cross-section of an ink channel at the chamber outlet downstream of the chamber outlet, wherein the size of the cross-section of said ink channel is selected so large that the pressure wave will be substantially completely reflected at the second end of the actuation chamber.

5. Inkjet print head according to claim 1, wherein a first pressure wave is generated by the piezo actuator propagating towards the second end of the actuation chamber and, after reflection at the second end, propagating towards the nozzle; and a subsequent second pressure wave is generated by the piezo actuator also propagating towards the second end, wherein the dimensions of the actuator chamber are selected such that the reflection of the first pressure wave and the second pressure wave arrive at the nozzle at the same time such that a large pressure is generated by the sum of the reflection of the first pressure wave and the second pressure wave.

6. Inkjet print head according to claim 1, wherein the piezo actuator extends in the first direction.

7. Inkjet print head according to claim 1, wherein the nozzle is arranged such that upon generation of a pressure wave a droplet is expelled in a direction substantially parallel to the first direction.

8. Inkjet print head comprising at least one elongated actuation chamber, wherein at least a main part of the actuation chamber substantially extends in a first direction, each actuation chamber associated with a respective piezo actuator arranged to generate a pressure wave in the main part of the actuation chamber, the pressure wave propagating in said first direction;

chamber inlet arranged at a first end of the elongated actuation chamber;

nozzle arranged in fluid communication with the associated actuation chamber such that a droplet may be expelled through the nozzle upon generation of the pressure wave in the actuation chamber;

chamber outlet arranged at a second end of the associated actuation chamber;

a reservoir in fluid communication with the chamber inlet and the chamber outlet of the at least one actuation chamber; and a pump configured to pump ink from the reservoir, through the chamber inlet, through the actuation chamber, through the chamber outlet and into said reservoir, wherein a flexible member is provided at the second end of the actuation chamber to reflect the pressure wave, wherein the flexible member is arranged and configured to generate a sufficient pressure at the nozzle for expelling the droplet.

9. Inkjet print head according to claim 8, the inkjet print head comprising a first actuation chamber associated with a first piezo actuator, with a first chamber inlet, with a first nozzle and with a first chamber outlet; and a second actuation chamber associated with a second piezo actuator, with a second chamber inlet, with a second nozzle and with a second chamber outlet;

wherein the reservoir is in fluid communication with the first actuator chamber and the second actuator chamber.

10. Inkjet print head according to claim 8, wherein flexible member is a nozzle plate and the nozzle is arranged in the nozzle plate.

11. Inkjet print head according to claim 8, wherein a cross-section of the actuation chamber at the chamber outlet at the second end of the actuation chamber is substantially smaller than a cross-section of an ink channel at the chamber outlet downstream of the chamber outlet, wherein the size of the cross-section of said ink channel is selected so large that the pressure wave will be substantially completely reflected at the second end of the actuation chamber.

12. Inkjet print head according to claim 8, wherein a first pressure wave is generated by the piezo actuator propagating towards the second end of the actuation chamber and, after reflection at the second end, propagating towards the nozzle; and a subsequent second pressure wave is generated by the piezo actuator also propagating towards the second end, wherein the dimensions of the actuator chamber are selected such that the reflection of the first pressure wave and the second pressure wave arrive at the nozzle at the same time such that a large pressure is generated by the sum of the reflection of the first pressure wave and the second pressure wave.

13. Inkjet print head according to claim 8, wherein the piezo actuator extends in the first direction.

14. Inkjet print head according to claim 8, wherein the nozzle is arranged such that upon generation of a pressure wave a droplet is expelled in a direction substantially parallel to the first direction.

* * * * *